United States Patent [19]

Boller

[11] Patent Number: 4,896,648

[45] Date of Patent: Jan. 30, 1990

[54] GUIDE RAIL AND LINK CHAIN FOR CHAIN SAW

[75] Inventor: Willi Boller, Agasul-Illnau, Switzerland

[73] Assignee: Gamma Stawag AG, Rumlang, Switzerland

[21] Appl. No.: 257,307

[22] PCT Filed: Oct. 20, 1987

[86] PCT No.: PCT/CH87/00144

§ 371 Date: Aug. 23, 1988

§ 102(e) Date: Aug. 23, 1988

[87] PCT Pub. No.: WO88/04602

PCT Pub. Date: Jun. 30, 1988

[30] Foreign Application Priority Data

Dec. 23, 1987 [CH] Switzerland ..... 05208/86

[51] Int. Cl.[4] ..... B28D 1/08

[52] U.S. Cl. ..... 125/21; 30/123.4; 30/382; 30/383

[58] Field of Search ..... 125/21, 12, 36; 30/123.3, 123.4, 382, 383; 83/169; 299/63, 83; 175/89, 90

[56] References Cited

U.S. PATENT DOCUMENTS

| | | | |
|---|---|---|---|
| 2,656,832 | 10/1953 | Perrier et al. | 125/21 |
| 2,748,810 | 6/1956 | Strunk | 30/123.4 |
| 3,459,169 | 8/1969 | McNulty | 175/89 X |
| 3,478,787 | 11/1969 | Piller | 30/123.4 |
| 3,545,422 | 12/1970 | McNulty | 125/21 |
| 4,434,556 | 3/1984 | Nitschmann et al. | 30/123.4 |
| 4,546,755 | 10/1985 | Gustavsson | 125/21 |
| 4,641,432 | 2/1987 | Kume | 30/383 |
| 4,693,007 | 9/1987 | Apfel et al. | 30/383 X |

FOREIGN PATENT DOCUMENTS

| | | | |
|---|---|---|---|
| 3332051 | 3/1984 | Fed. Rep. of Germany | 125/21 |
| 0875054 | 10/1981 | U.S.S.R. | 299/63 |

*Primary Examiner*—Fredrick R. Schmidt
*Assistant Examiner*—Shirish Desai
*Attorney, Agent, or Firm*—Tarolli, Sundheim & Covell

[57] ABSTRACT

On two opposite long narrow sides of a guide rail (1) of a chain saw for stone are arranged slide rails (3) of plastic. The slide rails (3) are located between the side walls (18, 19) of the guide rail. A link chain (2) consists of slide elements (6) and pairs of side guide members (7, 8) which are joined with each other through links (5). The slide elements (6) lie, on one side, on a surface (15) of the slide rail (3) and have, on the opposite side, cutting plates (4). In the slide rail (3) are arranged central coolant channels (13) which are connected with the coolant feed present in the core of the guide rail (1). The side guiding of the chain (2) is assured through the side guide members (7, 8) lying against the side surfaces (11, 12) of the slide rail (3).

7 Claims, 1 Drawing Sheet

GUIDE RAIL AND LINK CHAIN FOR CHAIN SAW

BACKGROUND OF THE INVENTION

1. Technical Field

The invention relates to a guide rail and link chain for a chain saw used for finishing work on concrete, stone and masonry and in particular to a guide rail having coolant channels.

2. Description of the Prior Art

One such link chain for a chain saw is known from the German Publication DE No. 3,332,051 A1. Here, the guide rail, also called the "sword", is provided on the lengthwise side with additional rails of metal. The guide rail is designed hollow. The hollow space serves as a channel for coolant, and on the side surfaces of the additional rails, coolant channels are arranged. The respective link chain consists of rollers, supported on pegs which are joined with each other by guide and connecting members. The rollers run on the outer surfaces of the additional rails, and the chain is turned, at the front end of the guide rail, over a chain wheel. The guide members of the chain are fastened to the cutting plates set with diamonds, which serve as cutting tools.

Although the chain can be constantly fed through the guide rail with coolant and lubricant, such guide rail and link chain systems have high wear and a short life. The dust from the cutting plates and that from the cut, settle on the additional rails, the guide members and the rollers which wears these metal parts away to the point of destruction. The cutting dust also penetrates between all the sliding surfaces, and the allowable clearance between the parts is very quickly exceeded through wear. Since such chains are very expensive, they cannot be economically used because of the rapid wear. The frequent replacement of chains necessary, and the interruption of operation cause high operation costs also.

SUMMARY OF THE INVENTION

The purpose of the present invention is to provide a guide rail and link chain system, which has a long useful life, in which the wear between the chain members and the guide members is low, which has high security against disturbances, and which is simple to produce.

This problem is solved through the features defined in the distinguished part of claim 1. Further advantages of the invention are given according to the features of the dependent claims.

The guide rail and link chain system according to the invention, has a much greater life than the known chain saws. This is attained by the fact that the guide rail of the chain saw has on both lengthwise sides, slide rails of plastic, on which metal slide elements of the chain slide. The slide rails are laid into grooves located on the lengthwise sides of the guide rail and are made of plastic material with high resistance to dust of abrasion and to water. Since the coolant channels extend through the central portion of the slide rails, the cooling and lubricating fluid comes out of the middle of slide surface. In this way, the cutting and grinding dust is rinsed away from the zone of the slide surface, and between the slide rails and the slide elements of the chain, a fluid film is formed, which prevents wear of the metal chain members against the slide rails.

The links in the chain are completely shielded from the outside environment, and grinding and cutting dust cannot penetrate into the links. This is assured, on the one hand, by the fact that the sliding surfaces of the links are covered on all sides, and on the other hand, by lubricant from the center of the link which is consistently pressed over all the sliding surfaces toward the outside. Water-resistant greases with additives, such as molybdenum and other known additives are suitable as lubricants. In the contact zone of the sliding surfaces between the slide elements and the slide rails, the pressure of the coolant provides that only slight amounts of lubricant come out of the sliding surfaces between the guide members and the slide elements. In this way, the loss of lubricant is slight and the links can be relubricated within the normal interruptions of work. With regular lubrication of the chain and feeding of sufficient coolant through the guide rail, the guide rail and link chain system of the present invention reaches lifetimes which are several times greater than in the known link chains for concrete, stone and masonry. Since the parts of the chain consist of flat elements which are not arched or bent, they can easily be ground exactly to dimensions, by which an economical chain can be built. Since the cutting plates are fastened to support plates, there is no danger that the hardened chain members will be softened by soldering. Moreover, the cutting plates with their support plates can be placed on the chain members at the most favorable point in time for the manufacture, which in turn makes possible a simpler and better production of the chain.

BRIEF DESCRIPTION OF THE DRAWINGS

One example of execution of the invention is explained in detail below, with reference to the drawings, in which.

DESCRIPTION OF A PREFERRED EMBODIMENT

Figure 1:
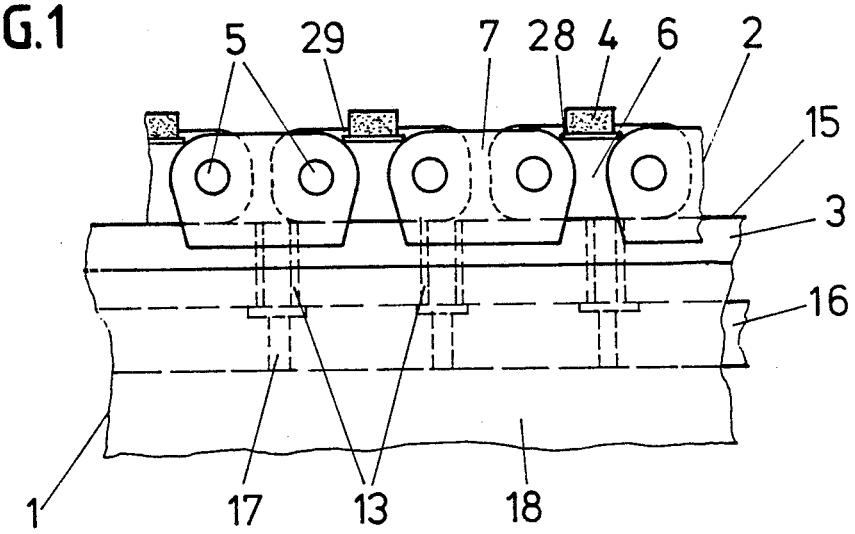
FIG. 1 shows a portion of a guide rail with a link chain for a chain saw, in side view.

The section represented in FIG. 1 of a guide rail 1, or sword, of a chain saw, shows the front side wall 18, an intermediate piece 16 to which are fastened the side walls to maintain the side walls the proper mutual distance apart, and an upper slide rail 3 lying on the intermediate piece 16. The slide rail 3, in the example shown, consists of Bakelite, that is, a layer-pressed material, and is inserted into the space between the side walls 18, 19 of the guide rail 1. On the sliding surface 15 of the slide rail 3 lie the slide elements 6 of the link chain 2. The slide elements 6 are joined together, through links 5, by means of the side guide members 7, 8. To the upper side of the slide elements 6 are fastened cutting plates 4, which are formed from hardened metal plates, set with diamonds.

Figure 2:
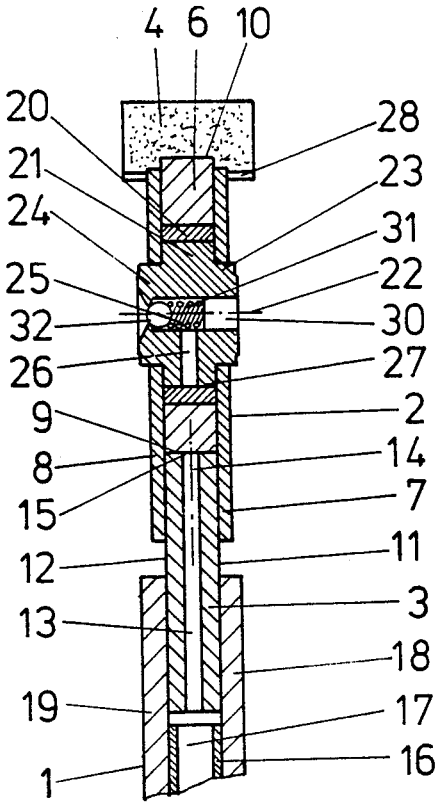
FIG. 2 shows a cross section through the link chain and the upper part of a guide rail through one link of the link chain.

FIG. 2 shows the link chain 2 and the edge of the guide rail 1, in enlarged representation. The section shown passes through one of the links 5 and a coolant channel 13 in the slide rail 3. The link 5 consists of a bolt 21, which has offset pegs 23, 24 at both ends. The pegs 23, 24 have a smaller diameter than the intermediate portion of the bolt 21. The bolt 21 is rotatably supported in a bearing bushing 20, which is pressed into the slide element 6. The pegs 23 and 24 are also supported in bores in the side guide members 7 and 8, being fixedly connected in the known way, with these side guide members 7 and 8. In the example shown, this is done by the fact that the outer surfaces of the pegs 23 and 24 are deformed into a ring, and in this way, material is driven outwardly and the bolt 21 is clamped to the side guide members 7 and 8. The dimensions between the two side guide members 7 and 8, as well as the width of the bearing bushing 20 and the slide element 6 are so chosen that the slide elements 6 and the side guide members 7 and 8 can be swung, easily and free of play, around the axis 22 in relation to each other. The side guide members 7 and 8 are also designed so that they overlap the side surfaces 11, 12 of the slide rail 3, and in this way, the link chain 2 is guided sidewise on the slide rail 3 with the least possible play. The slide elements 6 have on their underside, sliding surfaces 9, which lie on the surfaces 15 of the slide rail 3. Through the intermediate pieces 16 in the guide rail 1, coolant channels 17 lead outward from the inner hollow space of the guide rail 1. From these coolant channels 17 lead out, in each case, two coolant channels 13, which are arranged in the center of the slide rail 3. The outlet openings of these coolant channels 13 are on the surface 15 of the slide rail 3, in the area of the central axis 14. Thus, the coolant fed through the guide rail 1 flows through the coolant channels 17 and 13, and flows outwardly over the surface 15.

In the center of the link 5 is a lubricant channel 25, closed at one end by a plug 30, and has at the other end a ball valve 32 biased by a spring 31. From the central lubricant channel 25 go out one or more radial bores 26, which form lubricant channels and make possible the feeding of lubricant to the outer surface 27 of the bolt 21. The ball valve 22 prevents the penetration of water but makes possible the pressing of water-resistant molybdenum grease into the lubricant channels 25 and 26. Along the outer surface 27 of the bolt 21, the grease is pressed outward and also fills the slide surfaces between the slide elements 6 and the side guide members 7 and 8. In this way, the coolant and the grinding or cutting dust are prevented from penetrating between these slide surfaces and damaging them. In the relubrication, any dirt particles which have penetrated in are carried outward, and also the dirt particles carried by the stream of coolant through the coolant channels 13 are carried away from these slide surfaces. The guide rail and link chain system has, in this way, a self-cleaning effect, and provides constantly for an optimal lubrication and a slide film between all sliding surfaces. Since the pegs 23, 24 of the bolt 21 are connected, form-fitting, with the side guide members 7 and 8, respectively, the outer surface 27 of the slide surface of the bolt 21 is encapsulated toward the outside and protected from dirt.

As can be seen from FIGS. 1 and 2, the cutting plates 4 are fastened to bearing plates 28. The fastening of the cutting plates 4 to the bearing plates 28 normally takes place through hard soldering methods. The bearing plates 28 cover the entire base surface of the cutting plates 4, by which there is given between the cutting plates 4 and the bearing plates 28 the greatest possible adhesion and contact surface. On the slide elements 6, corresponding openings are provided at the upper end 10, while cams 29 grip over the projecting edges of the bearing plates 28. The fastening of the bearing plates 28 into the openings or onto the cams 29 of the slide elements 6, takes place by gluing or riveting the cams 29. This fastening process assures a simple and secure fastening and prevents the hardened slide elements 6 from being made soft again through attaching the cutting plates 4 by a soldering process. According to the load on the chain and the kind of use, the bolts 21 and the bearing bushings 20 have a hardness of 55 to 65 Rockwell C, or HRC, and the slide elements 6 and the side guide members 7 and 8 a hardness of 35 to 48 Rockwell C or HRC. As coolant may be used any known cutting and coolant aid for stone work.

I claim:

1. Guide rail and link chain for a chain saw for the finishing of concrete, stone and masonry, wherein coolant channels extend through the guide rail and cutting plates are connected with chain members of the link chain, with the distinction that the guide rail (1) includes plastic slide rails (3) on both lengthwise sides, the chain (2) is guided by and contacts these plastic slide rails (3) only, the chain (2) includes pairs of side guide members (7, 8), and each of the side guide members (7, 8) overlaps and lies against a respective outer side surface (11, 12) of the slide rail (3), each pair of side guide members (7, 8) is interconnected through a link (5) and by metal slide elements (6), a sliding surface (9) of each slide element (6) is supported by the outer surface (15) of the slide rail (3) and the cutting plates (4) are located on a side (10) of the slide element (6) opposite from the guide rail (1).

2. Guide rail and link chain for chain saw according to claim 1 with the distinction that the link (5) includes a bearing bushing (20) pressed into the slide element (6), a bolt (21) rotatably supported in the bushing (20) and axially spaced apart pegs (23, 24), each peg (23, 24) being supported in a respective side guide member (7, 8) and rigidly joined with the respective side guide member (7, 8), and further including a lubricant channel (25) located along the axis (22) of the bolt (21) and having radial bores (26) extending to the outer surface (27) of the bolt (21).

3. Guide rail and link chain for chain saw according to claim 1 with the distinction that each cutting plate (4) is fastened on a support plate (28) and the support plate (28) is fixedly connected to a slide element (6).

4. Guide rail and link chain for chain saw according to claim 1 with the distinction that the slide rails (3) have coolant channels (13) directed toward the outside, and the outlet openings of the channels (13) are arranged in the area of a central axis (14) of the slide surface (13).

5. Guide rail and link chain for chain saw according to claim 1 with the distinction that the slide rails (3) consist of a layer pressed material based on a phenol resin.

6. Guide rail and link chain for chain saws for the finishing of concrete, stone and masonry, wherein coolant channels extend through the guide rail, and cutting plates are connected with chain members of the link chain, with the distinction that the guide rail (1) includes plastic slide rails (3) on both lengthwise sides, the chain (2) includes metal slide elements (6) connected with each other through a link (5) and the cutting plates (4) are located on a side (10) of the slide element (6) opposite from the guide rail (1), each of the side guide members (7, 8) overlaps a respective outer side surface (11, 12) of the slide rail (3) and lies against the respective outer side surface (11, 12), the link (5) includes a bearing bushing (20) pressed into the slide element (6), a bolt (21) rotatably supported in the bushing (20 and axially spaced apart pegs (23, 24), each peg (23, 24) being supported in a respective side guide member (7, 8) and rigidly joined with the respective side guide member (7, 8), and further including a lubricant channel (25) located along the axis (22) of the bolt (21) and having radial bores (26) extending to the outer surface (27) of the bolt (21), the bearing bushing (20) and the bolt (21) having a hardness of 55 to 65 Rockwell C and the slide element (6) and guide members (7, 8) having a hardness of 35 to 48 Rockwell C.

7. Guide rail and link chain for chain saws for the finishing of concrete, stone and masonry, wherein coolant channels extend through the guide rail, and cutting plates are connected with chain members of the link chain, with the distinction that the guide rail (1) includes plastic slide rails (3) on both lengthwise sides, the chain (2) includes metal slide elements (6) connected with each other through a link (5) and the cutting plates (4) are located on a side (10) of the slide element (6) opposite from the guide rail (1), each of the side guide members (7, 8) overlaps a respective outer side surface (11, 12) of the slide rail (3) and lies against the respective outer side surface (11, 12), the link (5) includes a bearing bushing (20) pressed into the slide element (6), a bolt (21) rotatably supported in the bushing (20) and axially spaced apart pegs (23, 24), each peg (23, 24) being supported in a respective side guide member (7, 8) and rigidly joined with the respective side guide member (7, 8), and further including a lubricant channel (25) located along the axis (22) of the bolt (21) and having radial bores (26) extending to the outer surface (27) of the bolt (21), the lubricant channels (25, 26) and all the interspaces of the links being filled with a water-resistant molybdenum grease.

* * * * *

UNITED STATES PATENT AND TRADEMARK OFFICE

CERTIFICATE OF CORRECTION

PATENT NO. : 4,896,648

DATED : January 30, 1990

INVENTOR(S) : Willi Boller

It is certified that error appears in the above-identified patent and that said Letters Patent is hereby corrected as shown below:

Column 4, Line 44, Claim 4, Change "(13)" to --(15)--

Column 4, Line 63, Claim 6, Insert --)-- after "(20"

Signed and Sealed this

Fourth Day of December, 1990

*Attest:*

HARRY F. MANBECK, JR.

*Attesting Officer*

*Commissioner of Patents and Trademarks*